US006300247B2

(12) United States Patent
Prabhu

(10) Patent No.: US 6,300,247 B2
(45) **Date of Patent: *Oct. 9, 2001**

(54) PRECONDITIONING POLISHING PADS FOR CHEMICAL-MECHANICAL POLISHING

(75) Inventor: Golpalakrishna B. Prabhu, San Jose, CA (US)

(73) Assignee: Applied Materials, Inc., Santa Clara, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/280,253

(22) Filed: Mar. 29, 1999

(51) Int. Cl.[7] ..... H01L 21/302
(52) U.S. Cl. ..... 438/691; 438/692; 438/693
(58) Field of Search ..... 438/691, 692, 438/693; 451/41, 56, 285, 444, 446; 216/89, 90

(56) References Cited

U.S. PATENT DOCUMENTS

| | | | | |
|---|---|---|---|---|
| 5,308,438 | * | 5/1994 | Cote et al. | 156/636 |
| 5,522,965 | * | 6/1996 | Chisholm et al. | 216/89 |
| 5,527,424 | | 6/1996 | Mullins . | |
| 5,879,226 | * | 3/1999 | Robinson | 438/692 |
| 5,934,980 | * | 8/1999 | Koos et al. | 451/41 |
| 6,012,968 | * | 1/2000 | Lofaro | 451/39 |
| 6,030,487 | * | 2/2000 | Fisher, Jr. et al. | 156/345 |

* cited by examiner

*Primary Examiner*—Benjamin L. Utech
*Assistant Examiner*—Duy-Vu Deo
(74) *Attorney, Agent, or Firm*—McDermott Will & Emory

(57) ABSTRACT

A polishing pad for CMP is rapidly preconditioned before actual use by impinging a stream of particles on the polishing surface. Embodiments of the present invention include linearly traversing an impinging jet stream of unagglomerated ceramic particles, e.g., silicon dioxide particles having a particle size of about 5 to about 50 nm, across the polishing surface of a rotating polishing pad to effect preconditioning in less than about 5 minutes.

15 Claims, 2 Drawing Sheets

PRECONDITIONING POLISHING PADS FOR CHEMICAL-MECHANICAL POLISHING

TECHNICAL FIELD

The present invention relates generally to semiconductor processing, particularly chemical-mechanical polishing (CMP). The present invention is applicable to polishing pads employed in CMP, particularly to preconditioning polishing pads before actual use in CMP.

BACKGROUND ART

Current semiconductor processing typically comprises forming an integrated circuit containing a plurality of conductive patterns on vertically stacked levels connected by vias and insulated by inter-layer dielectrics. As device geometries plunge into the deep sub-micron range, chips comprising five or more levels of metalization are formed.

In manufacturing multi-level semiconductor devices, it is necessary to form each level with a high degree surface planarity, avoiding surface topography, such as bumps or areas of unequal elevation, i.e., surface irregularities. In printing photolithographic patterns having reduced geometries dictated by the increasing demands for miniturzation, a shallow depth of focus is required. The presence of surface irregularities can exceed the depth of focus limitations of conventional photolithographic equipment. Accordingly, it is essential to provide flat planar surfaces in forming the various levels of a semiconductor device. Thus, in order to maintain acceptable yield and device performance, conventional semiconductor methodology involves some type of planarization or leveling technique at suitable points in the manufacturing process.

A conventional planarization technique for eliminating or substantially reducing surface irregularities is CMP, which typically involves holding and/or rotating a wafer against a rotating polishing platen covered with a polishing pad under a controlled pressure. The polishing pad is employed together with a chemical polishing slurry to polish, i.e., remove material from the wafer surface. Conventional polishing pads which interface with the wafer include open cell foamed polyurethane, such as Rodel IC 1000, or a sheet of polyurethane with a grooved surface, such as Rodel EX 2,000. A factor affecting high and stable CMP rates is pad conditioning, a technique for bringing the polishing pad surface into proper form for actual CMP. Polishing pads must be preconditioned before initial actual use as well as periodically conditioned after actual use in CMP to restore the rough surface texture for repeatable removal rates.

Conventional preconditioning to prepare the polishing pad for initial CMP use is effected by various techniques. One such technique involves cutting circumferential grooves into the polishing pad surface to channel slurry between the substrate surface and the pad. Such grooves are formed prior to polishing by means of a milling machine, a lathe or a press. Such preconditioning techniques are problematic in that ridges forming the grooves are worn down after repeated polishing cycles, and the smoothed out polishing surface results in a reduction of slurry delivery beneath the substrate surface. This type of degradation in pad roughness occurs over time and results in low, unstable and unpredictable polish rates.

Another conventional technique comprises preconditioning a polishing pad with a diamond conditioning disk. This preconditioning technique is also problematic in that dislodged diamonds from the disk retained by the polishing pad mix in with the polishing slurry and scratch the wafer surface. In addition, diamond conditioning disks must eventually be discarded once the diamonds are dislodged from the surface.

Another conventional preconditioning technique comprises polishing dummy or blanket wafers. This preconditioning technique typically comprises polishing a dummy blank wafer having a silicon oxide surface, i.e., silicon dioxide, with the polishing pad in a CMP apparatus to prepare the polishing pad for actual CMP use on production wafers. After removal of a few microns of the silicon dioxide surface, the polishing pad is sufficiently preconditioned for actual CMP use. This type of preconditioning using dummy or blanket wafers is conducted with a slurry, e.g., a silicon dioxide or alumina slurry, and can be employed in combination with the diamond disk preconditioning technique. However, preconditioning with dummy or blanket wafers is extremely time consuming, requiring at least 30 minutes to complete, and is extremely expensive in consuming numerous wafers, e.g., about ten wafers.

Mullins, in U.S. Pat. No. 5,527,424 discloses the disadvantages of various conventional preconditioning techniques. The invention disclosed by Mullins comprises a preconditioning plate having at least three intersecting radial ridges.

There exists a need for polishing pad preconditioning methodology which is efficient, cost effective and rapid. There also exists a need for an apparatus for preconditioning a polishing pad in an efficient, rapid and cost effective manner.

DISCLOSURE OF THE INVENTION

An advantage of the present invention is a rapid, cost effective and efficient method of preconditioning a polishing pad for actual use in CMP.

Another advantage of the present invention is an apparatus for preconditioning a polishing pad, for actual CMP, in a rapid, cost effective and efficient manner.

Additional advantages and other features of the present invention will be set forth in the description which follows and in part will be apparent to those having ordinary skill in the art upon examination of the following or may be learned from the practice of the present invention. The advantages of the present invention may be realized and obtained as particularly pointed out in the appended claims.

According to the present invention, the forgoing and other advantages are achieved in part by a method of preconditioning a polishing pad having a polishing surface, for use in chemical-mechanical polishing, the method comprising impinging particles on the polishing surface.

Another aspect of the present invention is an apparatus for preconditioning a polishing pad having a polishing surface for use in chemical-mechanical polishing, the apparatus comprising: a rotatable platen on which the polishing pad is to be mounted; and a jet nozzle positioned to impinge a stream of particles on the polishing surface.

Embodiments of the present invention include rotating a polishing pad on a platen while impinging a stream of ceramic particles, e.g., silicon dioxide, on the polishing surface through the jet nozzle. Embodiments of the present invention further include mounting the jet nozzle for lateral traversal across the polishing pad and for angular impingement.

Additional advantages of the present invention will become readily apparent to those skilled in this art from the following detailed description, wherein embodiments of the present invention are described, simply by way of illustration of the best mode contemplated for carrying out the present invention. As will be realized, the present invention is capable of other and different embodiments, and its several details are capable of modifications in various obvious respects, all without departing from the present invention. Accordingly, the drawings and description are to be regarded as illustrative in nature, and not as restrictive.

DESCRIPTION OF THE INVENTION

Figure 1:
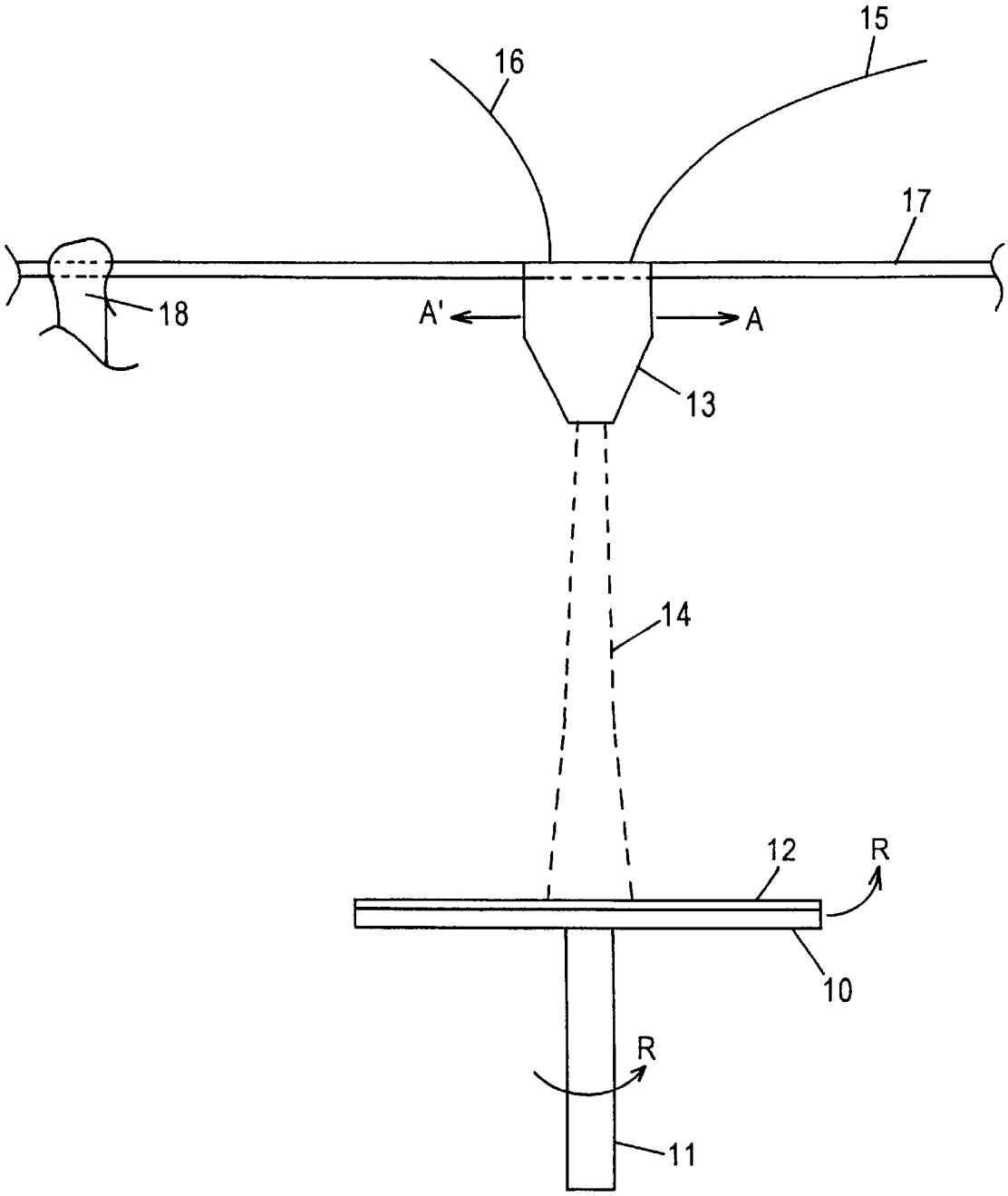
FIG. 1 schematically illustrates an apparatus in accordance with an embodiment of the present invention.

The present invention addresses and solves problems attendant upon conventional techniques for preconditioning a polishing pad for actual CMP use. As employed throughout this application, the term "preconditioning" denotes treating a polishing pad prior to actual initial use in CMP on semiconductor wafers.

In accordance with the present invention, the polishing surface of a conventional polishing pad is rapidly preconditioned in a cost effective, efficient manner by impinging a stream of relatively hard particles on the polishing surface. Embodiments of the present invention include impinging the particles on the polishing surface of the polishing pad through a jet nozzle employing a gas carrier, such as nitrogen, or a liquid, such as water, e.g., de-ionized water. Any of various conventional jet nozzles can be employed in implementing embodiments of the present invention.

Embodiments of the present invention also comprise impinging a stream of ceramic particles, such as silicon oxide, e.g., silicon dioxide, alumina or ceria. Given the objectives of the present invention, the optimum impingement parameters and particle size can be determined in a particular situation.

For example, in preconditioning a polyurethane polishing pad, such as Rodel IC 1000, it is suitable to impinge a stream silicon dioxide particles having a particle size of about 5 to about 50 nm, e.g., about 5 to about 15 nm. Advantageously, such silicon dioxide particles may be non-agglomerated and free flowing.

In various embodiments of the present invention, the particles are impinged on the polishing surface while rotating the polishing pad at a suitable speed, e.g., about 50 to about 150 rpm. The stream of particles is impinged on the polishing surface of the polishing pad at a suitably high particle speed, e.g., about 50 to about 500 feet per seconds, e.g., about 50 to about 200 feet per seconds. In practicing the present invention, preconditioning time can be reduced to less than about 5 minutes vis-α-vis in excess of 30 minutes required for conventional preconditioning techniques employing dummy wafers. Moreover, the present invention is cost effective in that dummy wafers are not consumed. The present invention is capable of preconditioning any of various types of polishing pads having various diameters, such as polishing pads having a diameter of 20 inches and 30 inches.

Embodiments of the present invention further comprise linearly traversing the impinging stream of particles across the polishing pad surface to ensure suitable preconditioning of the entire polishing surface. The stream of particles can be impinged on the polishing surface at any various angles to the polishing pad surface. For example, the stream of particles can be impinged in a suitably vertical direction, i.e., about 90°, to the polishing pad surface. Other suitable impinging angles include a grazing angle of slightly above 0°, e.g., about 5°, to about 90° with respect to the polishing pad surface.

The exact mechanism by which the present invention enables extremely rapid and effective preconditioning of a polishing pad is not known with certainty. However, it is believed that preconditioning using impinging particles in accordance with the present invention involves at least two significant phases. Initially, the impinging particles remove a minor portion of the upper, irregular surface of the polishing pad, e.g., about 500 Å to about one micron, including foreign contaminants which would adversely impact subsequent CMP. Consequently, a clean, uniform surface is formed conducive to uniform and reproducible CMP with high removal rates. Secondly, some of the impinging silicon dioxide particles become embedded in the pad surface, thereby simulating the initial break-in period achieved by using the dummy wafer technique. Thus, in accordance with the present invention, preconditioning time and costs are dramatically reduced.

An embodiment of an apparatus for use in the present invention is schematically illustrated in FIG. I and comprises platen 10 mounted on spindle 11 rotatable in the direction of arrow R. A fresh, unused polishing pad 12, such as an open cell foamed polyurethane polishing pad, e.g., Rodel IC 1000, is mounted on platen 10. Jet nozzle 13 contains inlet conduit 15 for a particular material, such as silicon dioxide, and inlet conduit 16 for a gas and/or liquid propellant. Jet nozzle 13 is mounted to carrier 17 above platen 10. The polishing surface of polishing pad 12 is preconditioned by impinging thereon an atomized, jet stream of particles 14 at an angle of about 90° with respect to the polishing pad surface. Jet nozzle 13 is capable of a linear movement in the direction of arrows A–A', thereby enabling linearly traversal of the atomized jet stream 14 across the polishing surface of polishing pad 12. Such linear motion can be effected in any convenient manner, as by mounting jet nozzle 13 such that it traverses carrier rod 17, or by fixing jet nozzle 13 to carrier rod 17 and providing for linear movement of carrier rod 17 with respect to mounting bracket 18.

Figure 2:
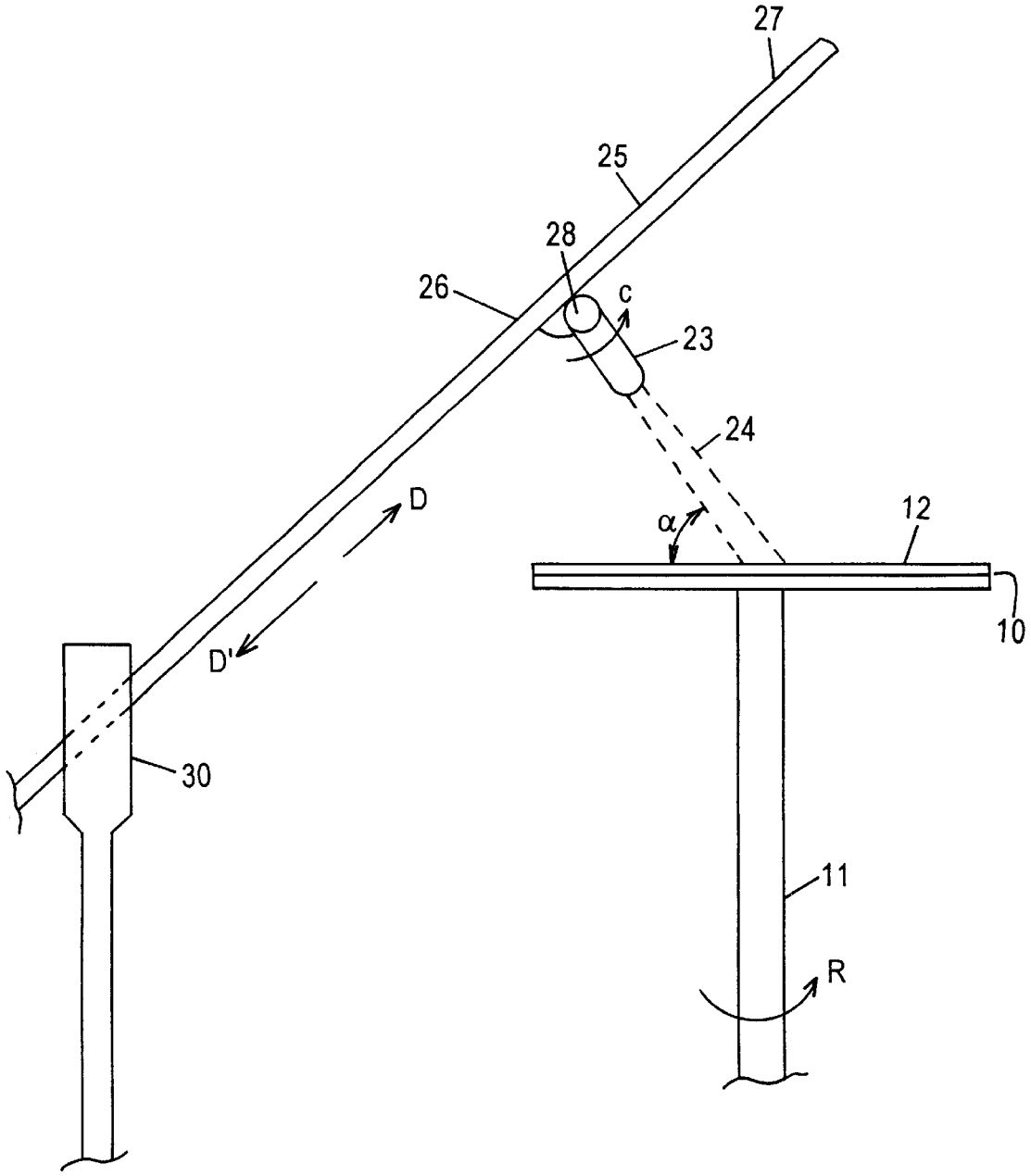
FIG. 2 schematically illustrates an apparatus in accordance with another embodiment of the present invention.

In another embodiment of the present invention, the jet nozzle is mounted such that the jet stream can be impinged at any of various angles to the polishing pad surface, e.g., at an angle between about 5° to about 90°. Adverting to FIG. 2, wherein similar elements to those appearing in FIG. 1 are denoted by similar reference numerals, platen 10 is mounted on rotatable spindle 11 capable of rotating in the direction of arrow R. Polishing pad 12 is mounted on platen 10. Jet nozzle 23 is pivotally mounted to carrier rod 27 by rotatable coupling 28, such that jet nozzle 23 is rotatable in the direction of arrow C. Accordingly, the atomized stream 24 can be impinged on the polishing surface of polishing pad 12 at an angle θ with respect to the polishing pad surface, e.g., about 5° to about 90°. Carrier rod 27 is capable of linear movement in the direction of arrows D–D' through mounting bracket 30, such that, at a desired angle θ, atomized stream of particles 24 can linearly traverse the surface of polishing pad 12. It should be recognized that various mechanical arrangements can be implemented for impinging atomize jet stream 24 at a desired angle θ to the upper surface of the polishing pad 12 and for implementing linear traversal.

The present invention enables rapid preconditioning of an unused polishing pad prior to initiating CMP on various topographies, e.g., a dielectric layer, metal layer or an in-laid dielectric layer containing damascene formed metal lines. The present invention provides cost effective methodology which avoids consumption of costly dummy wafers and can easily be implemented in existing back end processing systems. Subsequent to preconditioning, the polishing pad is placed in a conventional CMP apparatus for actual wafer polishing.

The present invention is applicable to the manufacture of various types of semiconductor devices. The present invention is particularly applicable in manufacturing multi-level semiconductor devices having sub micron features.

In the previous description, numerous specific details are set forth, such as specific materials, structures, chemicals, processes, etc., to provide a better understanding of the present invention. However, the present invention can be practiced without resorting to the details specifically set forth. In other instances, well known methodology, materials and features have not been described in detail in order not to unnecessarily obscure the present invention.

Only the preferred embodiment of the present invention and but a few examples of its versatility are shown and described in the present disclosure. It is to be understood that the present invention is capable of use in various other combinations and environments and capable of changes or modifications within the scope of the inventive concept as expressed herein.

What is claimed is:

1. A method of preconditioning a polishing pad having a polishing surface, for use in chemical-mechanical polishing, the method comprising:

impinging particles on the polishing surface during preconditioning of the polishing pad.

2. The method according to claim 1, comprising:

rotating the polishing pad; and impinging a stream of the particles on the polishing surface with a jet nozzle.

3. The method according to claim 2, wherein the particles comprise ceramic particles.

4. The method according to claim 3, wherein the particles comprise silicon dioxide, alumina or ceria.

5. The method according to claim 4, wherein the particles comprise silicon dioxide.

6. The method according to claim 5, wherein the silicon dioxide particles have a particle size of about 5 to about 50 nm.

7. The method according to claim 6, wherein the silicon dioxide particles have a particle size of about 5 to about 15 nm.

8. The method according to claim 2, comprising:

rotating the polishing pad at a speed of about 50 to about 150 rpm; and impinging a stream of the particles at a particle speed of about 50 to about 500 feet per seconds.

9. The method according to claim 8, comprising impinging the stream of the particles at a particle speed of about 50 to about 200 feet per seconds.

10. The method according to claim 2, comprising:

impinging a stream of the particles on the polishing surface; and laterally traversing the stream across the polishing surface.

11. The method according to claim 6, comprising:

rotating the polishing pad at a speed of about 50 to about 150 rpm; and impinging a stream of the particles at a particle speed of about 50 to about 500 feet per seconds.

12. The method according to claim 11, comprising impinging the stream of the particles at a particle speed of about 50 to about 200 feet per seconds.

13. The method according to claim 11, further comprising laterally traversing the stream of impinging particles across the polishing surface.

14. The method according to claim 2, comprising impinging the stream of particles on the polishing surface at an angle of about 5° to about 90° with respect to the polishing surface.

15. The method according to claim 1, wherein between approximately 500 Å to about one micron of the upper surface of the polishing pad is removed.

* * * * *